United States Patent [19]

Accettura et al.

[11] 4,393,765

[45] Jul. 19, 1983

[54] ALUMINUM CAN COMPACTOR

[76] Inventors: Albert Accettura; Wanda J. Accettura, both of 25502 Jacyln Ave., Sunnymead, Calif. 92388

[21] Appl. No.: 286,853

[22] Filed: Jul. 27, 1981

[51] Int. Cl.[3] ..... B30B 9/32

[52] U.S. Cl. ..... 100/98 R; 100/233; 100/295; 100/902

[58] Field of Search ..... 100/902, 233, 295, 98 R; 99/581, 582, 583

[56] References Cited

U.S. PATENT DOCUMENTS

| | | | |
|---|---|---|---|
| 2,603,270 | 7/1952 | Voigt et al. | 100/233 |
| 2,800,160 | 7/1957 | Wilson et al. | 100/902 X |
| 2,905,079 | 9/1959 | Brock | 100/902 X |
| 3,853,054 | 12/1974 | Jacobsen | 100/902 X |
| 4,212,242 | 7/1980 | Willis | 100/902 X |

FOREIGN PATENT DOCUMENTS

| | | | |
|---|---|---|---|
| 21219 | of 1893 | United Kingdom | 100/233 |

*Primary Examiner*—Billy J. Wilhite

[57] ABSTRACT

This compactor device is for crushing cans, so as to enable them to be stored in a smaller space than when they are in their normal dimensions, and it consists primarily of a base plate with a pair of legs attached. The legs include a cup portion, in which one end of an aluminum can is placed, and a handle is secured by a hinge to the base plate, and is used to compact the can by manual pressure of the user's hands.

2 Claims, 7 Drawing Figures

ALUMINUM CAN COMPACTOR

This invention relates to compressing tools, and more particularly, to an aluminum can compactor.

It is the principal object of this invention to provide an aluminum can compactor, which will compact a can to one-third or one-fifth of its size, so as to enable a great many aluminum cans to be stored in an area.

Another object of this invention is to provide an aluminum can compactor, which will be manually operated to compact aluminum cans, with a minimum of effort, and in a minimum amount of time.

Another object of this invention is to provide an aluminum can compactor, which will be adaptable for use in the average household, so as to lessen the number of trips to reclamation centers, and thus, saving time, energy and transportation costs.

A further object of this invention is to provide an aluminum can compactor, which will enable the householder to store more cans, until the best price for reclaimed metal is found, and which will allow the younger members of the family to operate the device safely, without a chance of injury.

A still further object of this invention is to provide an aluminum can compactor, which will be light in weight, easily assembled, easily stored, and may be rinsed off with a garden hose, and it will be fabricated of suitable materials, that will not rust or corrode easily.

An even further object of this invention is to provide an aluminum can compactor, which will lend itself to be an ideal mail order item.

Other objects of the present invention are to provide an aluminum can compactor, which is simple in design, inexpensive to manufacture, rugged in construction, easy to use and efficient in operation.

These, and other objects, will be readily evident, upon a study of the following specification, and the accompanying drawing, wherein.

Figure 1:
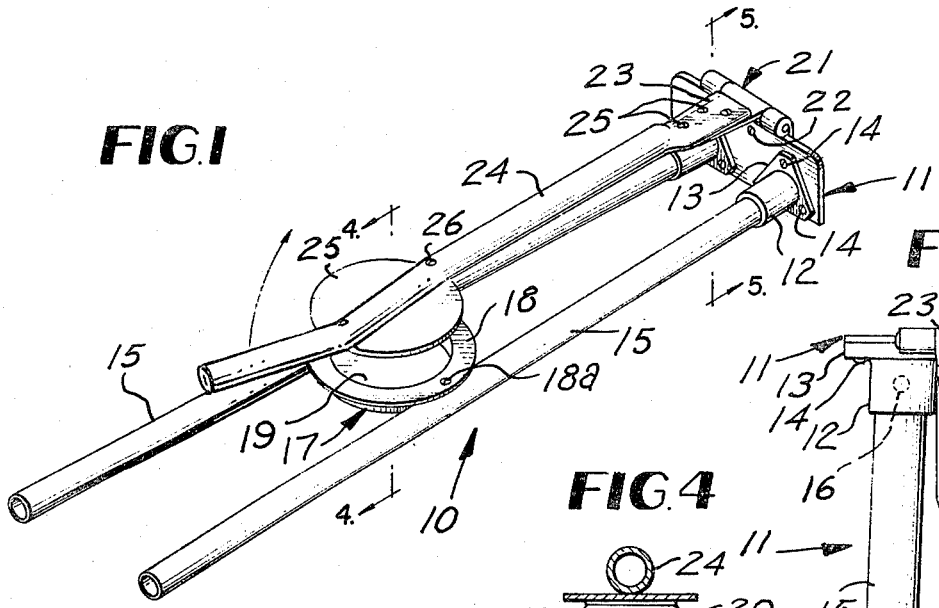
FIG. 1 is a perspective view of the present invention.
Figure 2:
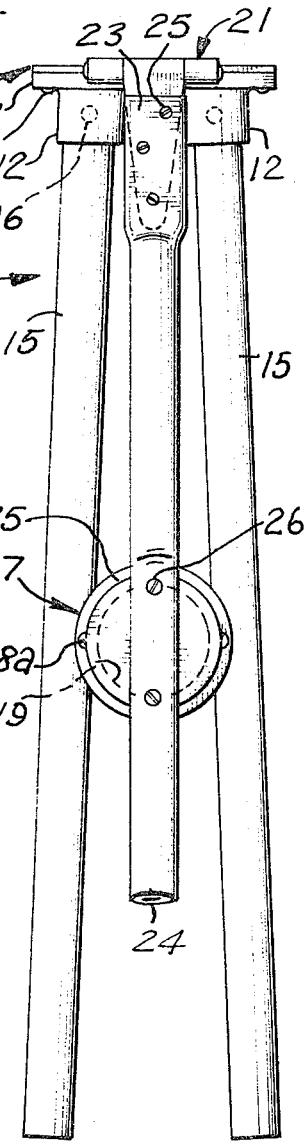
FIG. 2 is an enlarged top plan view of FIG. 1.
Figure 4:
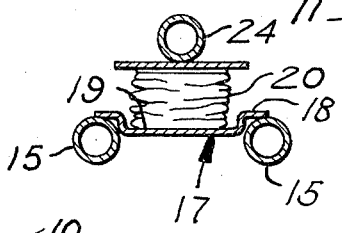
FIG. 4 is a cross-sectional view, taken along the line 4—4 of FIG. 1.
Figure 3:
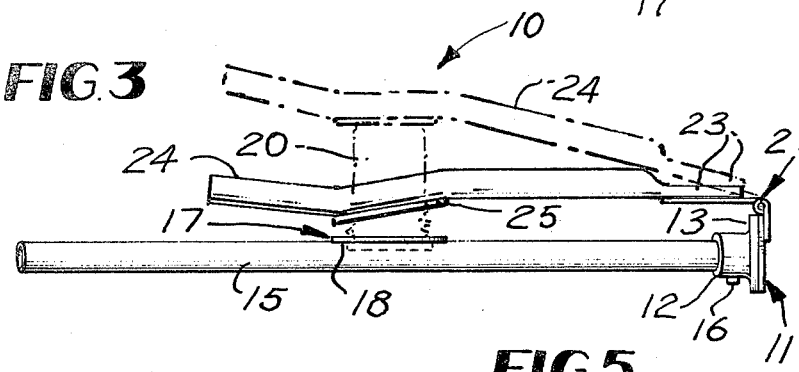
FIG. 3 is a side elevational view of FIG. 1.
Figure 5:
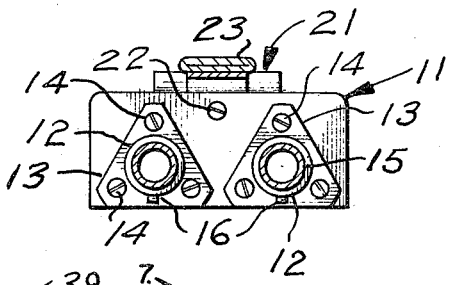
FIG. 5 is a cross-sectional view, taken along the line 5—5 of FIG. 1.

According to this invention, a compactor device 10 is shown to include a rectangular configurated base plate 11 of suitable material. A pair of spaced-apart metal sleeves 12, having a flange 13, are secured to one side of base plate 11, by suitable fasteners 14, through flanges 13 and base plate 11. One of each pair of tubular legs 15 is received in a sleeve 12, and is secured therein, by means of a suitable set screw fastener 16. A bucking cup 17, of suitable material, includes a flange 18, and the opening 19 therein removably receives an aluminum can 20, which is to be compacted in a manner which hereinafter will be described. Bucking cup 17 is secured to each of the legs 15, by means of suitable fasteners 18*a*, and one side of a hinge 21 is secured to base plate 11 at its opposite side, by means of suitable fasteners 22. The opposite side of hinge 21 is secured to the flattened end 23 of a tubular and angularly formed handle 24. Handle 24 is formed in the above mentioned manner, so as to prevent can 20 from slipping out of device 10 when in use.

A plate 25, of circular configuration, is secured to the bottom side of handle 15, so as to engage one end of can 20, and effectively compact it.

In use, handle 24 is raised, and a can 20 is placed in the opening 19 of cup 17, which renders can 20 stationary. Handle 24 is then pivoted downwards against the end of the can 20, the pressure applied, causing can 20 to compact. The handle 24 is then lifted, and the compacted can is removed therefrom.

It shall be noted, that for best results, can 20 is placed upside down, so as to compact it much more easily with less pressure.

It shall also be noted that, for older members of the family, this device will eliminate the physical damage to the foot, commonly known as "Bruised Heel."

Figure 6:
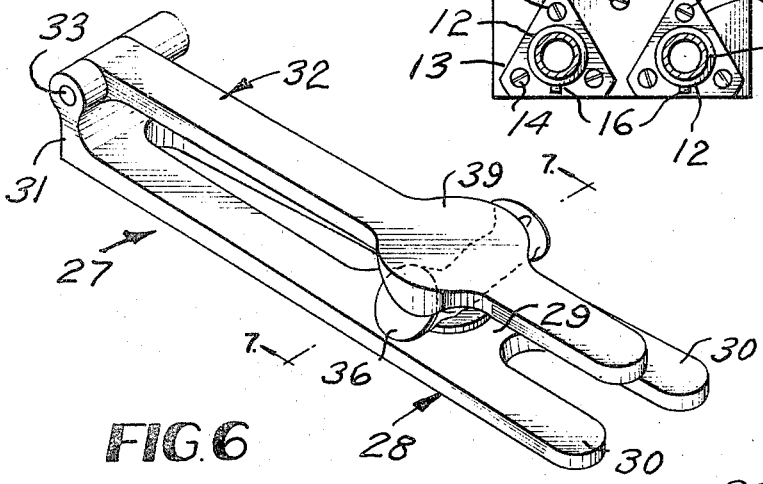
FIG. 6 is a perspective view of a modified form of the invention.
Figure 7:
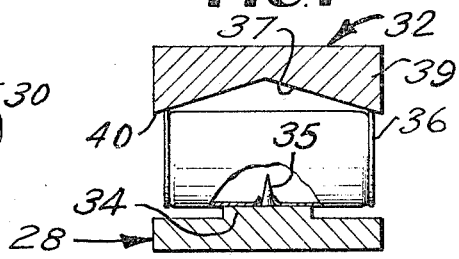
FIG. 7 is an enlarged cross-sectional view, taken along the line 7—7 of FIG. 6.

Referring now to FIGS. 7 and 6 of the drawing, a modified form of compactor device 27 is shown to include a base member 28, having a web portion 29, integral with its leg portions 30, near one end. The opposite end includes a hinge portion 31, hinged to one end of a handle 32, by a hinge pin 33. A raised portion 34, integral with web portion 29, includes a spike 35, fixedly secured to its center, for impaling can 36 thereon, so as to render it stationary. A recess 37, in the bottom of a circular portion 39 of handle 32, has its edges 40 engaging over the ends of can 36, so as to keep it in place when the handle 32 is pivoted downwards, to compact can 36.

In use, compactor device 27 is used in a similar manner, as was heretofore described of device 10, with the exception, that the spike 35 serves as a means of holding can 36 in place for being compacted by the circular portion 39 of handle 32.

While various changes may be made in the detail construction, it is understood that such changes will be within the spirit and scope of the present invention, as is defined by the appended claims.

What we now claim is:

1. An aluminum can compactor device, comprising, in combination, a base member and a handle pivotally connected thereto by a hinge at one end of said base member and one end of said handle, said base member including a pair of parallel, elongated legs, a web between a longitudinally intermediate portion of said legs, a raised stage portion upon said web and an upward spike upon said raised stage portion; and a circular portion along a longitudinally intermediate portion of said handle being aligned with said stage of said web when said handle is pivoted in a closed position against said base member, and an upwardly recess on an underside of said handle circular portion.

2. The combination as set forth in claim 1, wherein said recess extends conically upwardly from an edge of said handle circular portion, and an apex of said recess aligns with said spike when said handle and said base member are pivoted in said closed position.

* * * * *